United States Patent [19]

McLaurin et al.

[11] 4,312,406

[45] Jan. 26, 1982

[54] DEVICE AND METHOD FOR SHIFTING A PORT COLLAR SLEEVE

[75] Inventors: Charles H. McLaurin, Wichita Falls; Wayne F. Nelson, Waxahachie, both of Tex.

[73] Assignee: The Dow Chemical Company, Midland, Mich.

[21] Appl. No.: 122,947

[22] Filed: Feb. 20, 1980

[51] Int. Cl.[3] ..... E21B 43/00

[52] U.S. Cl. ..... 166/386; 166/212; 166/334

[58] Field of Search ..... 166/85, 207, 217, 212, 166/243, 315, 332, 334

[56] References Cited

U.S. PATENT DOCUMENTS

| | | | |
|---|---|---|---|
| 2,667,926 | 2/1954 | Alexander | 166/332 |
| 2,915,011 | 12/1959 | Hamill | 166/212 |
| 3,151,681 | 10/1964 | Cochran | 166/332 |
| 3,768,562 | 10/1973 | Baker | 166/289 |
| 3,948,322 | 4/1976 | Baker | 166/289 |
| 4,133,386 | 1/1979 | Knox | 166/212 |

*Primary Examiner*—James A. Leppink

*Attorney, Agent, or Firm*—V. Dean Clausen

[57] ABSTRACT

A tool is disclosed for shifting the sleeve of a port collar in a well casing, to open and close the ports in the collar. The basic tool is made up of a housing having a double piston assembly mounted slideably in a transverse bore in the housing. The transverse bore is intersected by a lengthwise bore in the housing. Fluid is carried into the housing from a tubing string connected into the lengthwise bore. The double piston assembly has an outside face in contact with fluid in the well casing, and an inside face in contact with fluid inside the housing bore. In addition, the outside face has a larger surface area than the inside face. This differential in the piston surface area allows the piston assembly to be held in a "retract" position by applying fluid pressure to the outside face. Alternatively, the piston assembly can be moved laterally to engage the port collar sleeve by applying fluid pressure to the inside face. Pulling the tubing string upwardly shifts the sleeve to a position which opens the collar ports. Setting weight on the tubing string moves the sleeve downwardly to close the collar ports.

9 Claims, 5 Drawing Figures

DEVICE AND METHOD FOR SHIFTING A PORT COLLAR SLEEVE

BACKGROUND OF THE INVENTION

The invention relates broadly to a tool useful for shifting a sleeve positioned slideably inside of a tubular member, such as a well casing. In a specific application, the tool is designed for shifting a slidable sleeve inside of a port collar, of the type used in well cementing operations.

When boreholes are drilled to recover oil or gas, a well casing is lowered into the hole and cemented, usually at the lower end of the hole and frequently at other locations above the lower end. When the lower end of the casing is cemented, usually referred to as primary cementing, a cement slurry is passed down through the casing and up into the annular space defined between the casing and the borehole. Cementing above the lower end of the borehole is usually done later than the primary cementing job, that is, during the productive life of the well. The later operations are sometimes referred to as secondary cementing, or stage cementing.

One of the devices commonly used in stage cementing operations is a port collar. A port collar can be generally described as a coupling between sections of well casing which has openings (ports) in the collar wall. Positioned inside the collar is a sliding sleeve, referred to as a port collar sleeve, which also has ports in the sleeve wall. Prior to cementing the sleeve is in a position such that it closes off the collar ports. When it is desired to pump cement into the borehole annulus through the openings in the port collar, a shifting tool is used to slide the sleeve to a position in which the sleeve ports and collar ports are in direct alignment.

Some of the known shifting tools are described in U.S. Pat. Nos. 2,667,926 (Alexander), 3,768,562 (Baker), and 3,948,322 (Baker). In general, the shifting tools described in these references require a mechanical operation which gives the tool several disadvantages. For example, the mechanical linkage of the tool can sometimes "hang up" inside the port collar-sleeve assembly. When this happens, it makes it difficult to disengage the tool between each shifting sequence. Another problem is that some of the tools are designed to engage and shift only one port collar at a time, that is, the engaging mechanism is not capable of being retracted to enable the tool to pass through one port collar to engage another. Another undesirable feature is that some of the tools require rotating the drill pipe to which the tool is fastened to latch the tool into the port collar sleeve.

The shifting tool of this invention overcomes the problems mentioned above, by providing an engaging mechanism which operates by hydraulic fluid pressure, rather than by mechanical linkage. The tool described herein is also simpler to operate than the prior tools because of fewer moving parts. In addition, this tool can pass through any number of port collars in a given drill string. This feature enables the tool to engage and shift each port collar sleeve an indefinite number of times in a given operation.

SUMMARY OF THE INVENTION

In its broadest application, the tool of this invention is useful for shifting a sleeve positioned slideably inside a tubular section, such as a well casing. As a specific application, the present tool is designed for shifting a port collar sleeve to open and close the ports in the collar. The port collar is coupled between sections of a well casing and it has fluid outlet ports therein. The port collar sleeve, which is slideable inside the collar also has fluid outlet ports therein.

This device includes a shifting tool assembly which, in operating position, sets inside of the port collar sleeve. The port collar sleeve is made up of a housing member and a piston assembly. Inside the housing member is a lengthwise bore, which is intersected by a transverse bore. The bottom end of a tubing string, which is positioned in the well casing, connects directly into the lengthwise bore of the housing member. At the top end, the tubing string is connected into a source of an operating fluid. The piston assembly is made up of double piston sections which are slideable along the transverse bore of the housing member.

The two piston sections of the assembly are referred to as an inside piston section and an outside piston section. The inside piston section has an operating face, and the outside piston section has a seating face. When the operating fluid is directed through the tubing string, under pressure, it engages the operating face of the inside piston. This causes the piston assembly to move outwardly, so that the seating face of the outside piston section can seat into the groove in the port collar sleeve.

The shifting tool also includes a hollow mandrel, a packing sleeve assembly, and a check valve assembly. The mandrel is fastened into the lengthwise bore of the housing member and there are several fluid outlet ports in the mandrel. The packing sleeve assembly is positioned on the outside of the mandrel such that it normally covers the fluid outlet ports in the mandrel. In another position, the packing sleeve remains in place in the well casing and the mandrel slides upwardly through the sleeve to uncover the fluid outlet ports. The check valve assembly is positioned inside the mandrel. This valve has a closed position in which fluid is blocked from flowing through the mandrel. In addition, the check valve has an open position in which fluid can flow through the mandrel.

DESCRIPTION OF A PREFERRED EMBODIMENT

Figure 1:
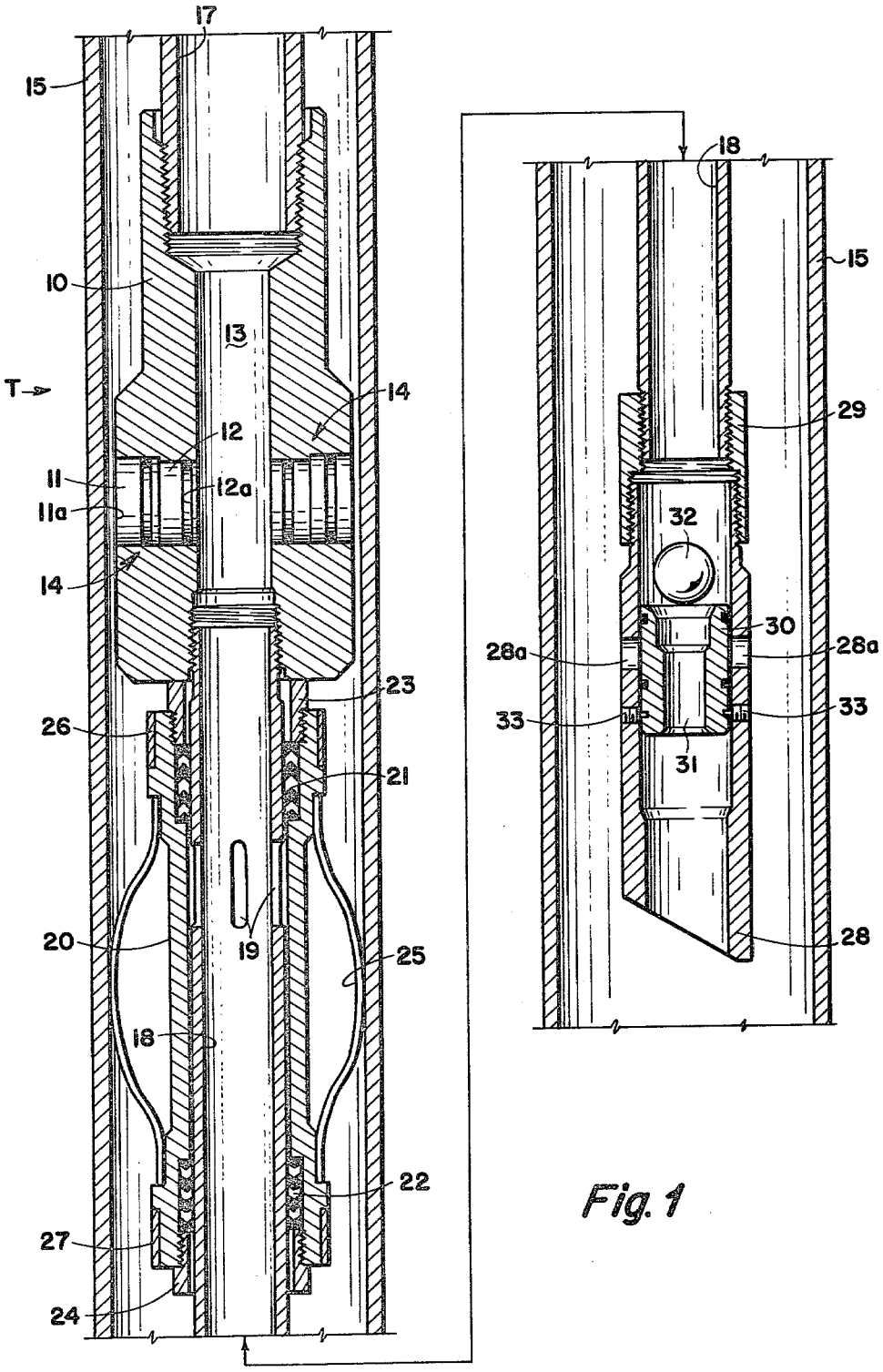
FIG. 1 is an elevation view, in section, illustrating the shifting tool of this invention as it appears while being run into a well casing.

In the drawing, the shifting tool assembly of this invention is designated generally by the letter T. The basic tool consists of a housing member 10 and a piston assembly, which includes an outside piston section 11 and an inside piston section 12. Inside the housing member 10 is a lengthwise bore 13, which is intersected by a transverse bore 14. The piston assembly is positioned to slide laterally within the bore 14. The bore 14 is indicated generally in FIGS. 1, 2 and 3, but it is best shown in detail views of FIGS. 4 and 5.

During an operating sequence, such as cementing, the tool T is lowered into a well casing 15. Sections of the well casing 15 can be coupled together by one or more port collars 16. The port collar 16 is shown only in the detail views of FIGS. 4 and 5. The top end of the housing member 10 is coupled into the bottom end of a tubing string 17, such that the tubing string communicates with bore 13 in the housing member. At the other end of the tubing string, it is connected into a source of an operating fluid. The fluid source is not illustrated herein. A hollow mandrel 18 is coupled into the bottom end of the bore 13 in housing member 10. Near the top end of mandrel 18 are several fluid outlet ports 19.

A packing sleeve assembly is positioned to slide up and down on the outside of mandrel 18 below the shifting tool assembly. A packing sleeve 20 defines the main part of this assembly. An upper packing element 21 is sandwiched between the sleeve 20 and mandrel 18, to seal the upper end of the sleeve. At the bottom end, the sleeve 20 is sealed by a lower packing element 22. Packing element 21 is held in place by a retainer ring 23. A similar retainer ring 24 holds the packing element 22 in place. The packing sleeve also includes several drag springs, which are indicated by numeral 25. Each drag spring is fastened into the top end of the packing sleeve 20 by a retainer ring 26. At the bottom of the sleeve a second retainer ring 27 clamps the springs to the sleeve.

Figure 2:
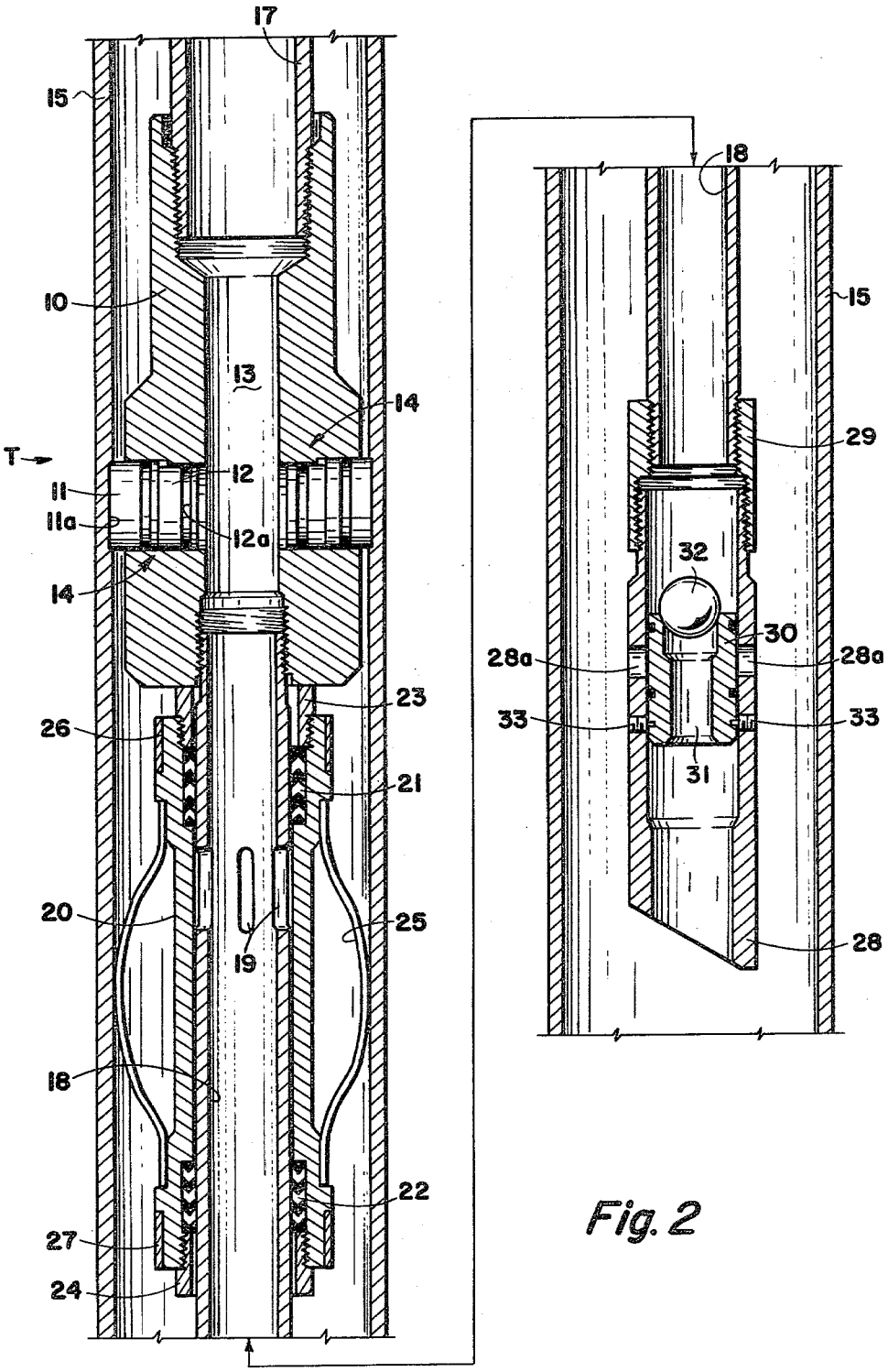
FIG. 2 is a second elevation view, in section, which illustrates schematically the position of the shifting tool when the tool is in engagement with a port collar sleeve, prior to shifting the sleeve.

A mule shoe 28 is fastened into the bottom end of mandrel 18 by a coupling 29. A check valve assembly is positioned inside of the mule shoe. In general, the check valve is made up of a nipple section 30, which has a lengthwise bore 31 therein, and a ball 32. A set of shear screws 33 holds the nipple section 30 in place inside the mule shoe 28. In its normal position inside the mule shoe 28, as illustrated in the drawing, the nipple section 30 seals off the fluid outlet ports **28*a* in the mule shoe. When fluid from the tubing string flows downwardly through the housing member and the mandrel 18, the ball 32 will seat into the upper end of bore 31 and stop the fluid flow at that point (note FIGS. 2 and 3). Conversely, the pressure of fluid flowing upwardly through the mule shoe 28 will cause the ball 32 to unseat from bore 31, as shown in FIG. 1**, and thereby allow unrestricted fluid flow through the mandrel, the housing member, and the tubing string.

Figure 4:
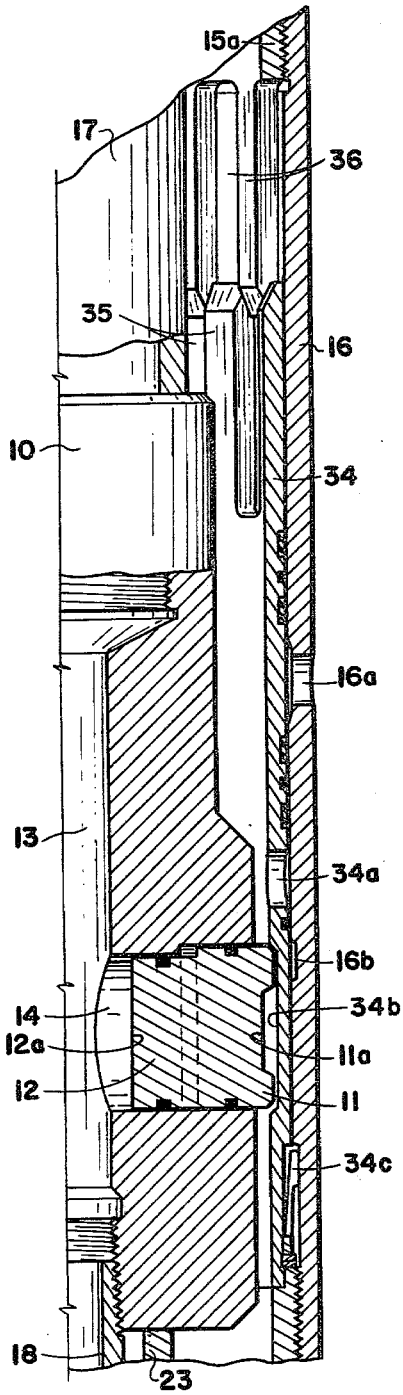
FIG. 4 is a detail view illustrating the position of the shifting tool and port collar sleeve before the sleeve is shifted to open the port collar.
Figure 5:
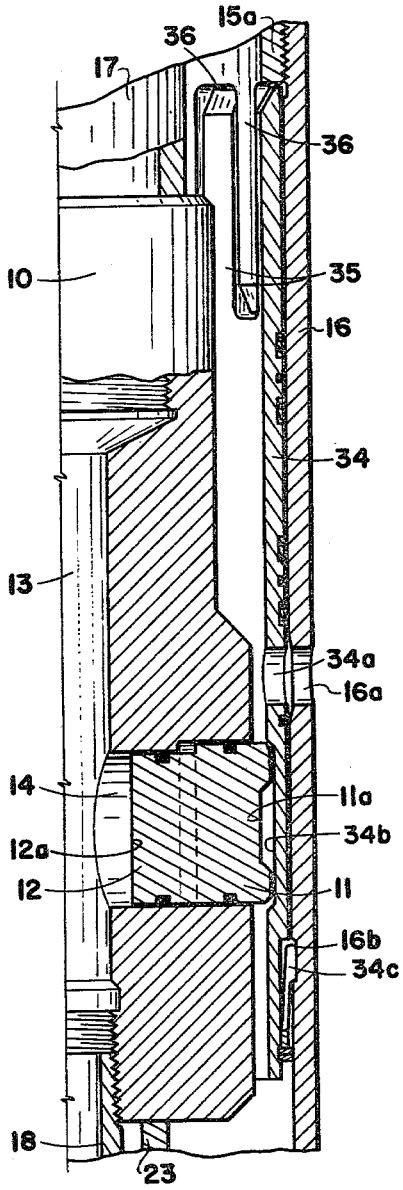
FIG. 5 is a second detail view showing the position of the shifting tool and the port collar sleeve after the sleeve has been shifted to a position which opens the port collar.

As shown in FIGS. 4 and 5, a port collar sleeve 34 is positioned inside the port collar 16. The port collar includes several fluid outlet ports **16*a*, and similar fluid outlet ports 34*a* are defined in the wall of sleeve 34. Numeral 35 refers to alternating fingers and slots, which are machined into the top end of sleeve 34. The fingers and slots 35 on sleeve 34 are adapted to mesh with a corresponding set of alternating fingers and slots 36, which are machined into the bottom end of a coupling 15*a*. The coupling 15*a* actually connects the port collar 16, at its top end, into a section of the well casing 15. As shown in FIG. 5, the upwardly-directed fingers and slots 35 mesh with the downwardly-directed fingers and slots 36 only when the port collar sleeve 34** is shifted upwardly. The shifting sequence for the port collar sleeve is explained in more detail later in this description.

OPERATION

The invention can be illustrated by describing use of the present shifting tool in a typical well cementing operation. Prior to injecting cement into the well casing 15, the shifting tool is run into the casing on the end of the tubing string 17, until it reaches a point just above the port collar 16. During the running-in step, as illustrated in FIG. 1, the ball 32 is unseated from the bore 31 in nipple section 30. As explained earlier, the ball is unseated by the pressure of that part of the fluid which passes upwardly through the mule shoe and into the mandrel, the housing member, and the tubing string. The rest of the fluid in the well casing will remain on the outside of the shifting tool, that is, between the shifting tool and the casing, during the run-in step.

Referring again to FIG. 1, as the shifting tool is lowered into the casing, the piston assembly is held in the retracted position by the hydrostatic pressure of that part of the fluid which remains on the outside of the tool. To explain further, the surface area of the seating face **11*a* of piston section 11 is greater than the surface area of the operating face 12*a* of piston section 12. For this reason, the fluid pressure which bears against the seating face 11*a* of piston section 11, during the running-in step, is greater than the fluid pressure which bears against the operating face 12*a* of piston section 12**. The result is that the piston assembly is pushed inwardly and held in a "retract" position as the shifting tool is lowered into the casing.

When the shifting tool reaches a point slightly above the port collar 16, additional pressure is applied to the fluid in the tubing string. As a typical example, the additional pressure applied is about 500 psi above the hydrostatic pressure of the fluid at that level. This causes the pressure against the operating face **12*a* of piston section 12 to be substantially greater than the normal hydrostatic pressure against this operating face. Therefore, when the shifting tool is lowered into the port collar sleeve 34, the higher pressure against the operating face 12*a* forces the piston assembly to move outwardly. As the piston assembly moves outwardly, the seating face 11*a* seats into a transverse groove 34*b* in the port collar sleeve 34. This sequence is illustrated schematically in FIG. 2 and in detail in FIG. 4**.

Once the piston assembly is seated into the port collar sleeve 34, an additional pressure of 500 psi is applied to the fluid in the tubing string. This is done to lock the piston assembly into the port collar sleeve. The port collar sleeve is then shifted upwardly by pulling up on the tubing string. The upward travel of the port collar sleeve 34 stops when the fingers and slots 35 on the sleeve are completely meshed with the fingers and slots 36 on coupling **15*a*. At this stop point the outlet ports 34*a* in sleeve 34 are directly aligned with the outlet ports 16*a* in port collar 16, as shown in FIG. 5. Also, at the stop point, a set of collet fingers 34*c*, which are mounted on sleeve 34, latch into a recess 16*b* on the port collar 16. The purpose of these collet fingers is to provide an additional means for properly locating the sleeve 34 relative to the port collar 16**.

Figure 3:
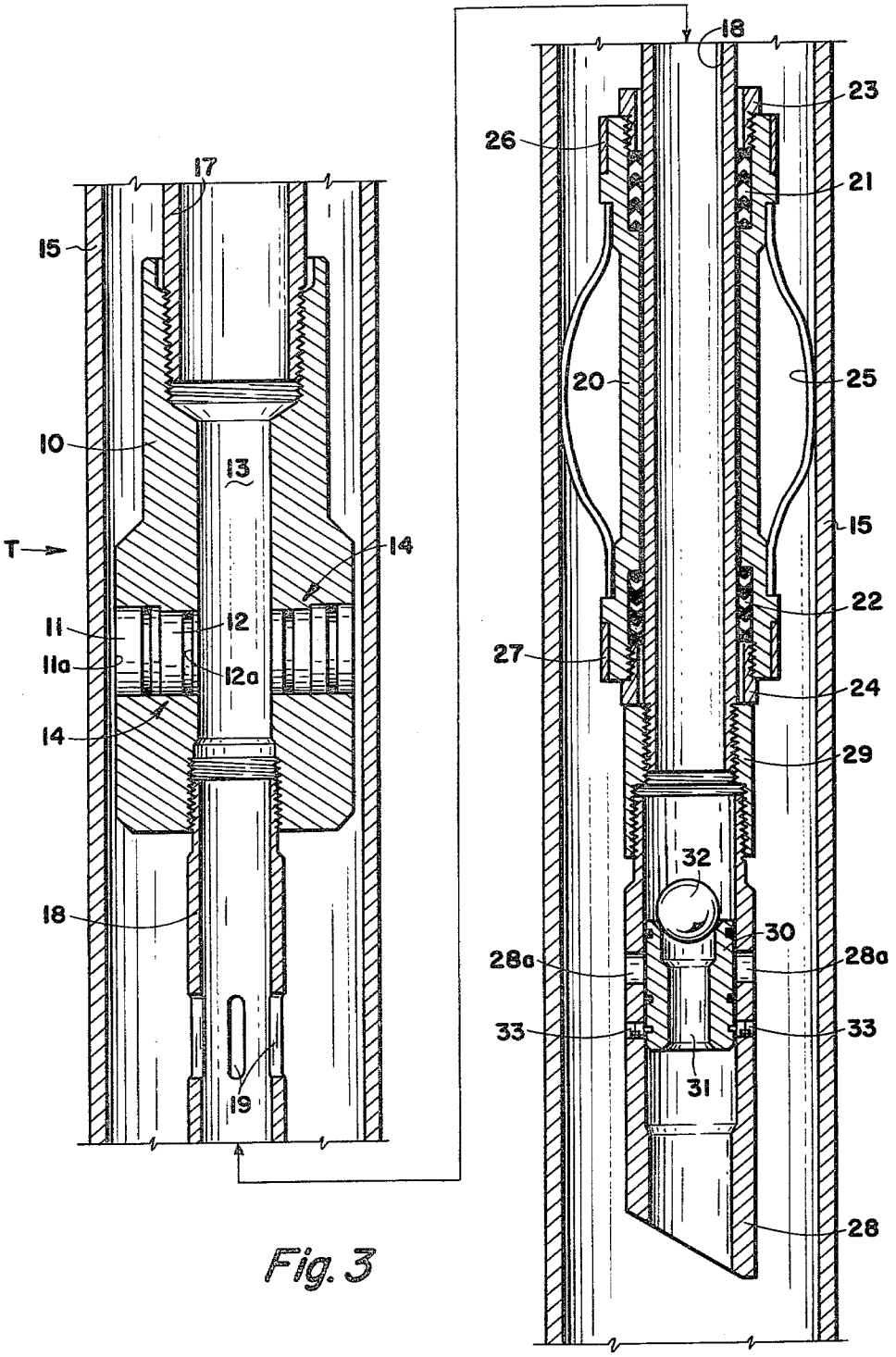
FIG. 3 is a third elevation view, in section, which illustrates the position of the shifting tool when it is being pulled out of the well casing.

Referring particularly to FIG. 3, after the port collar sleeve 34 has been shifted to line up the ports in sleeve 34 with the ports in collar 16, the next step is to disengage the shifting tool from sleeve 34. This is done by releasing pressure on the fluid in the tubing string, so that the piston assembly will retract. After the shifting tool is disengaged from sleeve 34, the tubing string 17 is pulled upwardly to remove the shifting tool from the well casing. Cement can then be pumped down the casing 15 and into the borehole annulus (not shown) through the open ports in the sleeve and collar assembly.

When the shifting tool is pulled upwardly on the end of the tubing string, the packing sleeve assembly remains stuck in the well casing because of the drag of springs 25 against the casing wall. With the packing sleeve remaining "fixed" in the casing, the mandrel 18 thus slides upwardly through the packing sleeve and uncovers the outlet ports 19 in the mandrel. The purpose in having ports 19 open is to permit the fluid in the tubing string to circulate into the casing, as the string is pulled up, to prevent a pressure build-up inside the string.

If a malfunction should occur in the packing sleeve assembly, so that the ports 19 are not uncovered when the tubing string is pulled upwardly, the pressure build-up in the string can be prevented by another means. For example, if such a malfunction takes place, sufficient pressure is applied to the fluid in the tubing string to shear the screws 33 which secure the nipple section 30 to the mule shoe 28. Shearing the screws 33 allows the nipple section 30 and ball 32 to slide down past the outlet ports 28*a* in the mule shoe. The fluid in the tubing string can then circulate into the casing through the open ports 28*a* in the mule shoe.

After the cementing operation, or other desired downhole operation is completed, the next step is to close the outlet ports in the port collar 16. This is done by running the shifting tool back into the well casing 15 to re-engage the port collar sleeve 34 in the same manner as described earlier. Once the piston assembly re-engages port collar sleeve 34, and is locked into place, enough weight is set on the tubing string 17 to move the sleeve back down to its original position (the position shown in FIG. 4), so that the sleeve again closes off the ports in collar 16.

What is claimed is:

1. In combination, a port collar, port collar sleeve, and tool for shifting the sleeve, the combination including:

a port collar which is coupled between sections of a well casing, and which has at least one fluid outlet port therein;

a port collar sleeve which has at least one fluid outlet port therein, which has a groove defined on the inside wall surface of said sleeve, and said sleeve being slideable within the port collar to an open position in which the fluid outlet port in said sleeve is in alignment with the fluid outlet port in said collar, and said sleeve being slideable to a closed position in which the fluid outlet port in said sleeve is not in alignment with the fluid outlet port in said collar;

a tubing string which has a top and bottom end, which is positioned in the well casing, and which is connected into a source of fluid at its top end;

a shifting tool assembly which is position inside the port collar sleeve, and which includes a housing member and a piston assembly;

the housing member having therein a lengthwise bore which is intersected by a transverse bore, the bottom end of the tubing string being connected into the lengthwise bore, and the tubing string being adapted to carry an operating fluid from the fluid source into the lengthwise bore of the housing member;

the piston assembly including an inside piston section and an outside piston section, the piston assembly being slideable inside the transverse bore of the housing member, the inside piston section having an operating face adapted to engage the operating fluid, and the outside piston section having a seating face adapted for seating into the groove in the port collar sleeve;

a hollow mandrel which has at least one fluid outlet port therein, and which fastens on one end into the lengthwise bore of the housing member;

a packing sleeve assembly which is positioned on the mandrel, which is slideable to a closed position in which the sleeve assembly covers the fluid outlet port in the mandrel, and which is slideable to an open position in which said fluid outlet port is uncovered;

a check valve assembly which is positioned inside the mandrel, said valve assembly having a closed position which blocks fluid from flowing through the mandrel, and an open position which allows fluid to flow through the mandrel.

2. The combination of claim 1 in which the seating face of the outside piston section has a greater surface area than the surface area of the operating face of the inside piston section.

3. The combination of claim 1 in which integral slots and fingers are defined in the upper end of the port collar sleeve, and in the lower end of a well casing section positioned above said sleeve, such that the respective fingers and slots of the well casing section and the port collar sleeve are able to mesh when the port collar sleeve moves to its closed position.

4. The combination of claim 1 in which the groove in the port collar sleeve is a transverse groove, and said groove is located below the fluid outlet port in the port collar sleeve.

5. The combination of claim 1 in which the packing sleeve assembly includes the combination of a sleeve which fits slideably on the mandrel, first and second packing elements which are positioned between the inside wall surface of the packing sleeve and the outside wall surface of the mandrel, and a set of drag springs, the springs being mounted on the outside of the packing sleeve, and adapted to ride against the inside wall surface of a well casing section.

6. The combination of claim 1 in which the check valve assembly includes the combination of a mule shoe coupled to the lower end of the mandrel, a nipple section positioned inside the mule shoe, and a ball adapted to seat onto the upper end of a lengthwise bore in the nipple section when fluid flows downwardly from the mandrel into the mule shoe, and the ball being adapted to unseat from the nipple bore when fluid flows upwardly through the mule shoe into the mandrel.

7. Tool for shifting a port collar sleeve, the sleeve being positioned slideably inside a port collar, and the sleeve having a groove defined on the inside wall surface thereof, the tool comprising:

a housing member and a piston assembly;

the housing member having therein a lengthwise bore which is intersected by a transverse bore, the lengthwise bore being connected into a tubing string adapted to carry an operating fluid into said lengthwise bore; and the piston assembly including an inside piston section and an outside piston section, the piston assembly being slideable inside the transverse bore of the housing member, the inside piston section having an operating face adapted to engage the operating fluid, and the outside piston section having a seating face adapted for seating into the groove in the port collar sleeve;

the port collar and port collar sleeve having one or more fluid outlet ports therein; such that the shifting tool is adapted to shift the port collar sleeve to an open position in which the fluid outlet ports in said sleeve and said collar are in alignment, and to a closed position in which said fluid outlet ports are not in alignment.

8. Method for shifting a port collar sleeve, the method comprising the steps of:

coupling a port collar between sections of a well casing, the collar having at least one fluid outlet port therein;

positioning the port collar sleeve slideably inside of the port collar, the sleeve having at least one fluid outlet port therein, and a groove defined on the inside wall surface of said sleeve;

positioning a shifting tool assembly inside the port collar sleeve, the shifting tool assembly including a housing member and a piston assembly, the housing member being in communication with a tubing string, the tubing string being positioned in said well casing and adapted to carry an operating fluid, the piston assembly being slideable inside the housing member, the piston assembly having an operating face adapted to engage the operating fluid, and a seating face adapted for seating into the groove in the port collar sleeve;

directing the operating fluid under pressure through the tubing string and into the housing member, to engage the operating face of the piston assembly;

causing the piston assembly to move toward the port collar sleeve, in response to the operating fluid pressure, such that the seating face of said piston assembly seats into the groove in the port collar sleeve;

pulling the shifting tool assembly upwardly to thereby move the port collar sleeve into a position at which the fluid outlet port in said sleeve is in direct alignment with the fluid outlet port in the collar.

9. The method of claim 8 which further includes the steps of:

reducing the pressure against the operating fluid sufficiently to cause the operating face of the piston assembly to disengage from the groove in the port collar sleeve; and pulling upwardly on the tubing string to remove the shifting tool from the well casing.

* * * * *